US006578599B1

(12) United States Patent
Ura

(10) Patent No.: US 6,578,599 B1
(45) Date of Patent: Jun. 17, 2003

(54) WASHING HOSE STORING DEVICE

(76) Inventor: Kimasaru Ura, 4-2-52-703, Shiohama, Ichikawa-shi, Chiba 272-0127 (JP)

( * ) Notice: Subject to any disclaimer, the term of this patent is extended or adjusted under 35 U.S.C. 154(b) by 13 days.

(21) Appl. No.: 09/890,942

(22) PCT Filed: Dec. 20, 2000

(86) PCT No.: PCT/JP00/09072

§ 371 (c)(1),
(2), (4) Date: Aug. 6, 2001

(87) PCT Pub. No.: WO01/47795

PCT Pub. Date: Jul. 5, 2001

(30) Foreign Application Priority Data

Dec. 24, 1999 (JP) ..... 11-366884

(51) Int. Cl.[7] ..... B65H 75/34
(52) U.S. Cl. ..... 137/355.16
(58) Field of Search ..... 137/355.16, 355.2, 137/355.28

(56) References Cited

U.S. PATENT DOCUMENTS

| | | | | |
|---|---|---|---|---|
| 2,286,904 A | * | 6/1942 | Ewald | 137/355.28 X |
| 4,402,790 A | * | 9/1983 | Lynn et al. | 201/1 |
| 4,540,017 A | | 9/1985 | Prange | |
| 5,526,842 A | * | 6/1996 | Christensen | 137/355.16 X |

FOREIGN PATENT DOCUMENTS

| | | |
|---|---|---|
| JP | 56-37968 | 4/1981 |
| JP | 143889/1983 | 4/1985 |
| JP | 7-137943 | 5/1995 |
| JP | 76556/1993 | 6/1995 |
| JP | 9-322694 | 12/1997 |

* cited by examiner

*Primary Examiner*—Kevin Lee

(57) ABSTRACT

A washing hose storing device, wherein guide means (31) guiding a washing hose (2) from an inner peripheral surface **(3*a*) of a rotary housing (3) to an extracting hole (8) is disposed between the extracting hole (8) and the center part of the rotary housing (3)**, whereby the extracting and storing operations of the washing hose can be facilitated.

3 Claims, 8 Drawing Sheets

WASHING HOSE STORING DEVICE

TECHNICAL FIELD

This invention relates to a drain pipe washing device for washing pipeline facilities such as drain pipes installed in apartment buildings and other buildings, and particularly to drive control operations for a washing hose used in a drain pipe washing device and to a washing hose storing device for storing the same.

BACKGROUND ART

Drain pipe washing devices have been provided conventionally wherein a high pressure hose (washing hose) is used for washing drain pipes and other pipeline facilities. In the forward end of the hose, which is a comparatively rigid hose that does not bend readily, such as a stainless steel hose, is provided a nozzle having injection holes for jetting high pressure water. The high pressure hose is inserted in a drain pipe so that the interior thereof is washed by high pressure water jetted from the injection holes in the nozzle.

With such a drain pipe washing device, a washing hose storing device is used that, in addition to compactly accommodating the high pressure hose when not in use, is also for extracting the high pressure hose, when it is used, into the drain pipe, and applying a turning drive thereto inside the drain pipe when washing that drain pipe.

This conventional washing hose storing device 1, as diagrammed in FIG. 8, is configured of a substantially cylindrically shaped (doughnut shaped) rotary housing 3 that accommodates a comparatively rigid high pressure hose (washing hose) 2 that does not readily bend by winding the hose on the inner peripheral surface 3*a* thereof, and a drive shaft 4 that rotatably supports the rotary housing 3. The drive shaft 4 is supported rotatably by a bearing 6 in a frame 5 configured of pipe and sheet material or the like.

A substantially cone-shaped cover 7 is provided in an opening 3*b* in the rotary housing 3 described above, and a extracting hole 8 for extracting the high pressure hose 2 is formed in the forward end of the cover 7, at a position in opposition to the rotary housing 3.

In the extracting hole 8 is screwed a lock bolt 9 for locking the extracting of the high pressure hose 2.

In the axial center of the drive shaft 4 described above, furthermore, is formed a washing liquid guide channel 4*a* for conducting the high pressure water constituting the washing liquid, and at the forward end thereof, the back end 2*a* of the high pressure hose 2 is connected through a hose connection joint 11. At the rearward end of the washing liquid guide channel 4*a* is connected, via a connecting hose joint 12, the forward end of a washing liquid supply hose 13 that conducts washing water supplied from a high pressure pump (not shown).

According to such a washing liquid guiding structure as this, the washing liquid (arrow) sent under pressure from a high pressure pump (not shown) is conducted from the washing liquid supply hose 13 to the washing liquid guide channel 4*a* in the drive shaft 4, and from there is conducted through the hose connection joint 11 into the high pressure hose 2.

At the forward end of the high pressure hose 2 described above, furthermore, is secured a commonly known nozzle 15 having injection holes 14 opened in the peripheral surface thereof at a prescribed pitch, and at the forward end of that nozzle 15 is connected a universal guide 16, also commonly known.

For the detailed structure of the nozzle 15 and guide 16, the reader is referred to Japanese Patent Application Laid-Open No. S62-163789 filed previously by the applicant.

The high pressure hose 2 described in the foregoing is configured by a stainless steel hose, for example, that is comparatively rigid and that does not readily bend. Therefore, when it is wound and accommodated inside the rotary housing 3, due to its own springiness whereby it tries to return to its natural linear shape, the high pressure hose 2 will be wound and accommodated in a condition where the hose 2 is in tight contact with the inner peripheral surface of the rotary housing 3.

Meanwhile, in the washing hose storing device 1 described in the foregoing, a driving device (not shown) is provided for driving the rotary housing 3 so that it turns, and follower means (a follower pulley or follower gear) 17 configuring a part thereof are secured between the rotary housing 3 and the bearing 6.

When a follower pulley is used as the follower means 17, moreover, the rotary housing 3 is turned by a driving device having a manual drive pulley (not shown), whereas, when a follower gear is used as the follower means 17, the rotary housing 3 is turned via a motor (not shown) and a drive gear secured to the drive shaft thereof.

When the rotary housing 3 is turned in this manner, the high pressure hose 2 also turns, following that turning, and, thereby, the nozzle 15 will turn inside the drain pipe and wash the inside of the drain pipe.

According to the washing hose storing device 1 described in the foregoing, when, as diagrammed in FIG. 9, the lock bolt 9 in the extracting hole 8 is loosened, and, thereafter, an operator inserts the nozzle 15 into a drain pipe 20, while pulling the high pressure hose 2 out from the extracting hole 8, as indicated by the arrow A, and also causes the rotary housing 3 to turn in one direction by drive means (not shown), the nozzle 15 will advance while turning in a spiral pattern inside the drain pipe 20, and, while that is happening, solidified waste material adhering to the inside of the drain pipe 20 will be stripped away by the high pressure water C jetted from the injection holes 14.

When the washing operation inside the drain pipe 20 is finished, the operator pulls the high pressure hose 2 back, as indicated by the arrow B, while turning the rotary housing 3 in the other direction, pushes it into the extracting hole 8, and thereby accommodates the high pressure hose 2 inside the rotary housing 3.

Now, based on the conventional washing hose storing device 1 described in the foregoing, when the operator pulls the high pressure hose 2 from the extracting hole 8 as indicated by the arrow A in FIG. 9, part of that high pressure hose 2, due to its own springiness, strikes part of the opening 3*b* or extracting hole 8 in the rotary housing 3 with a strong force to constitute a load. As a consequence, it is difficult to extract the high pressure hose 2 smoothly from the extracting hole 8, which constitutes a difficulty.

Furthermore, when the operator pushes the high pressure hose 2 into the extracting hole 8, as indicated by the arrow B in FIG. 9, part of that high pressure hose 2 abuts against part of the inner peripheral surface 3*a* of the rotary housing 3 or part of the drive shaft 4, as diagrammed in FIG. 10, resulting in a large load. As a consequence, a difficulty arises in that the high pressure hose 2 cannot be accommodated smoothly inside the rotary housing 3.

Furthermore, in order to smoothly wind up the high pressure hose 2 on the inner peripheral surface 3*a* of the rotary housing 3 and accommodate it, the operation of pushing the high pressure hose 2 into the extracting hole 8 while turning the rotary housing 3 in one direction is necessary. For this reason, a difficulty arises in that, when turning the rotary housing 3 by a driving device, the operation of taking in the high pressure hose 2 by the operator is extremely troublesome.

When this operation is done by driving the rotary housing 3 to turn using a manually operated driving device, that difficulty becomes even more pronounced.

An object of the present invention, which was devised with the circumstances described in the foregoing in view, is to provide a washing hose storing device wherewith the operations of pulling out and taking in the washing hose are made easy.

DISCLOSURE OF THE INVENTION

In order to resolve the problems set forth in the foregoing, the present invention is a washing hose storing device in which a washing hose is wound up so as to be in tight contact with an inner peripheral surface of a substantially cylindrical rotary housing, and when the washing hose is to be used, the washing hose is pulled out from a extracting hole formed at a position in opposition to a center part of the rotary housing and when not in use, the washing hose is pulled back inside the extracting hole, wound up so as to be in tight contact with the inner peripheral surface of the rotary housing, and accommodated, wherein guide means for guiding the washing hose from inner peripheral surface of the rotary housing to the extracting hole is provided between the extracting hole and the center part of the rotary housing. Therefore, during the operations of pulling the washing hose out from the rotary housing and pulling it back, the washing hose will not strike other unnecessary parts of the rotary housing, and will not stop the advance thereof. Thus, the operations of pulling out and taking in the washing hose from and into the rotary housing are made extremely easy.

BEST MODE FOR CARRYING OUT THE INVENTION

A detailed description is herebelow given of one embodiment of the washing hose storing device according to the present invention.

Figure 1:
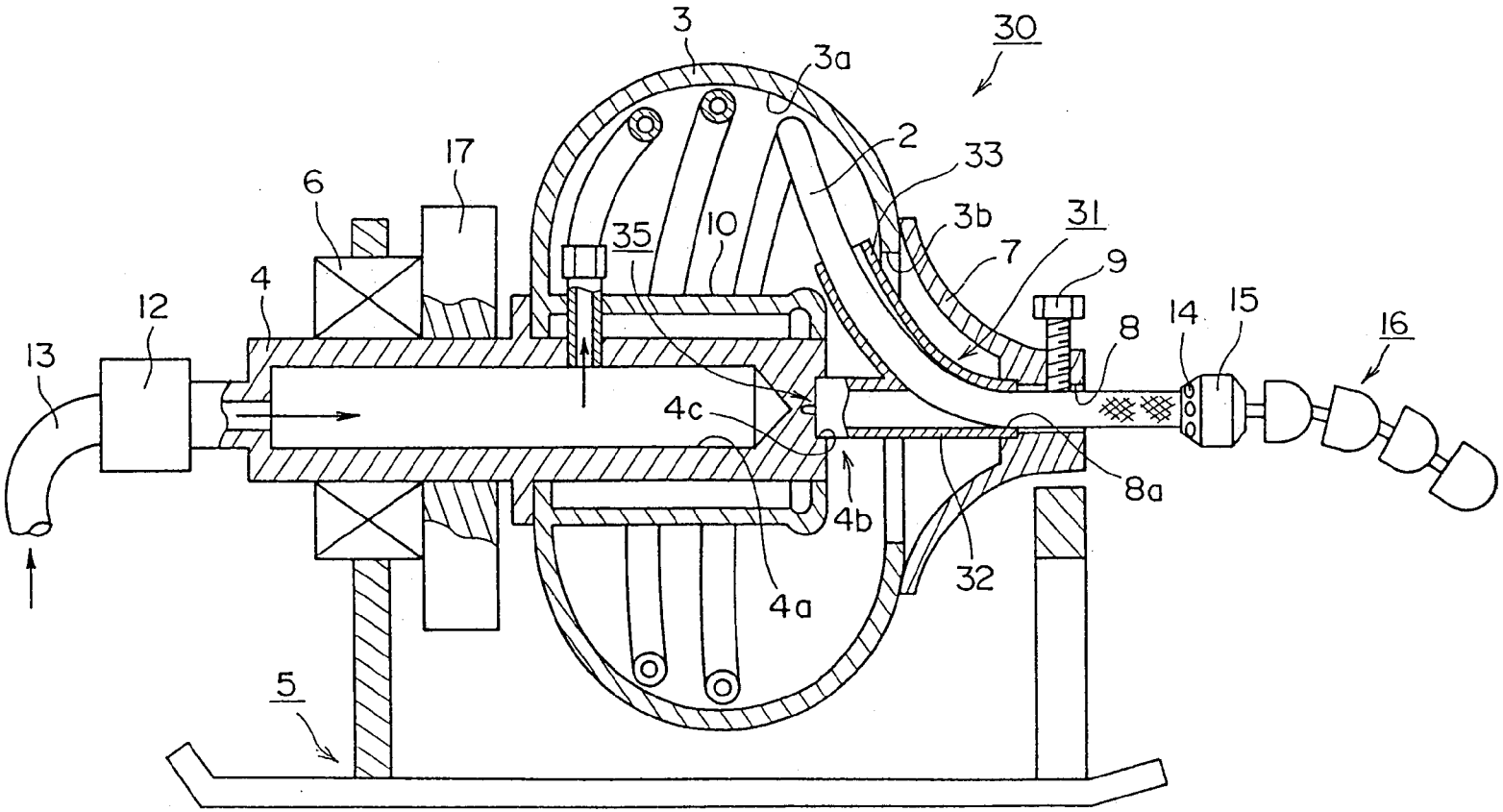
FIG. 1 is a cross-sectional view of a washing hose storing device according to the present invention.
Figure 8:
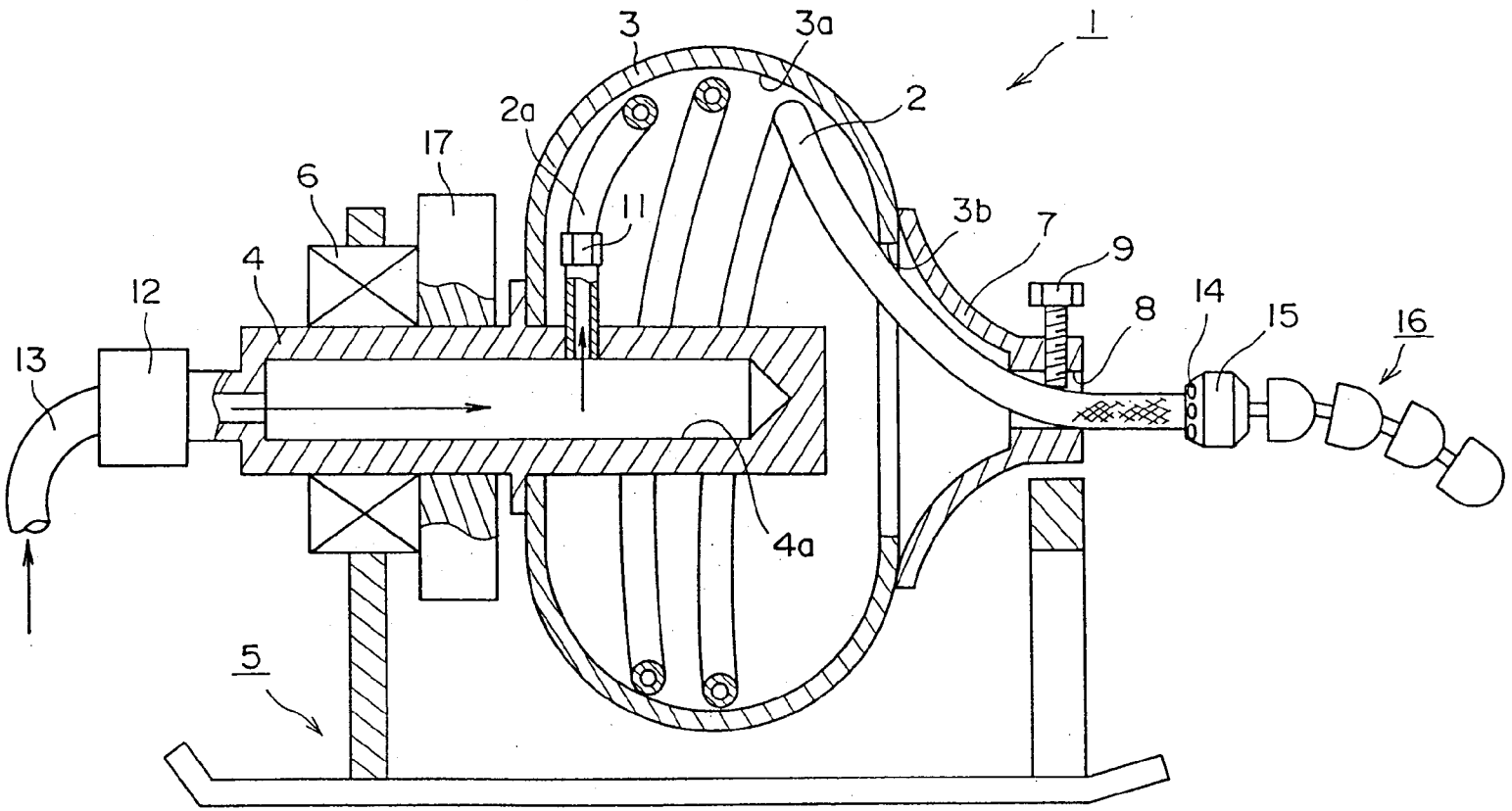
FIG.8 PRIOR ART
FIG. 8 is a cross-sectional view of a conventional washing hose storing device.
Figure 9:
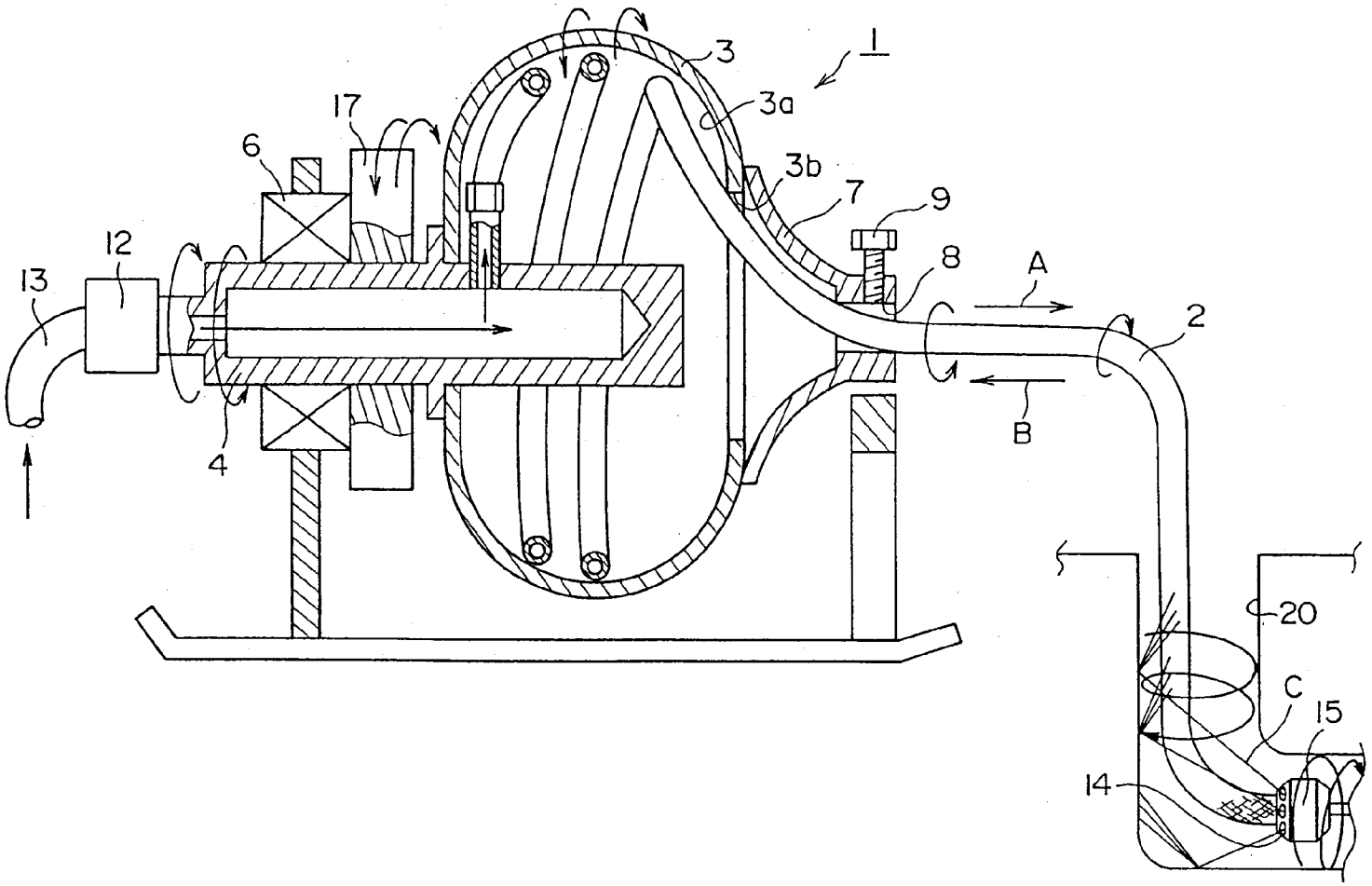
FIG.9 PRIOR ART
FIG. 9 is a schematic cross-sectional view representing the operation of the conventional washing hose storing device.
Figure 10:
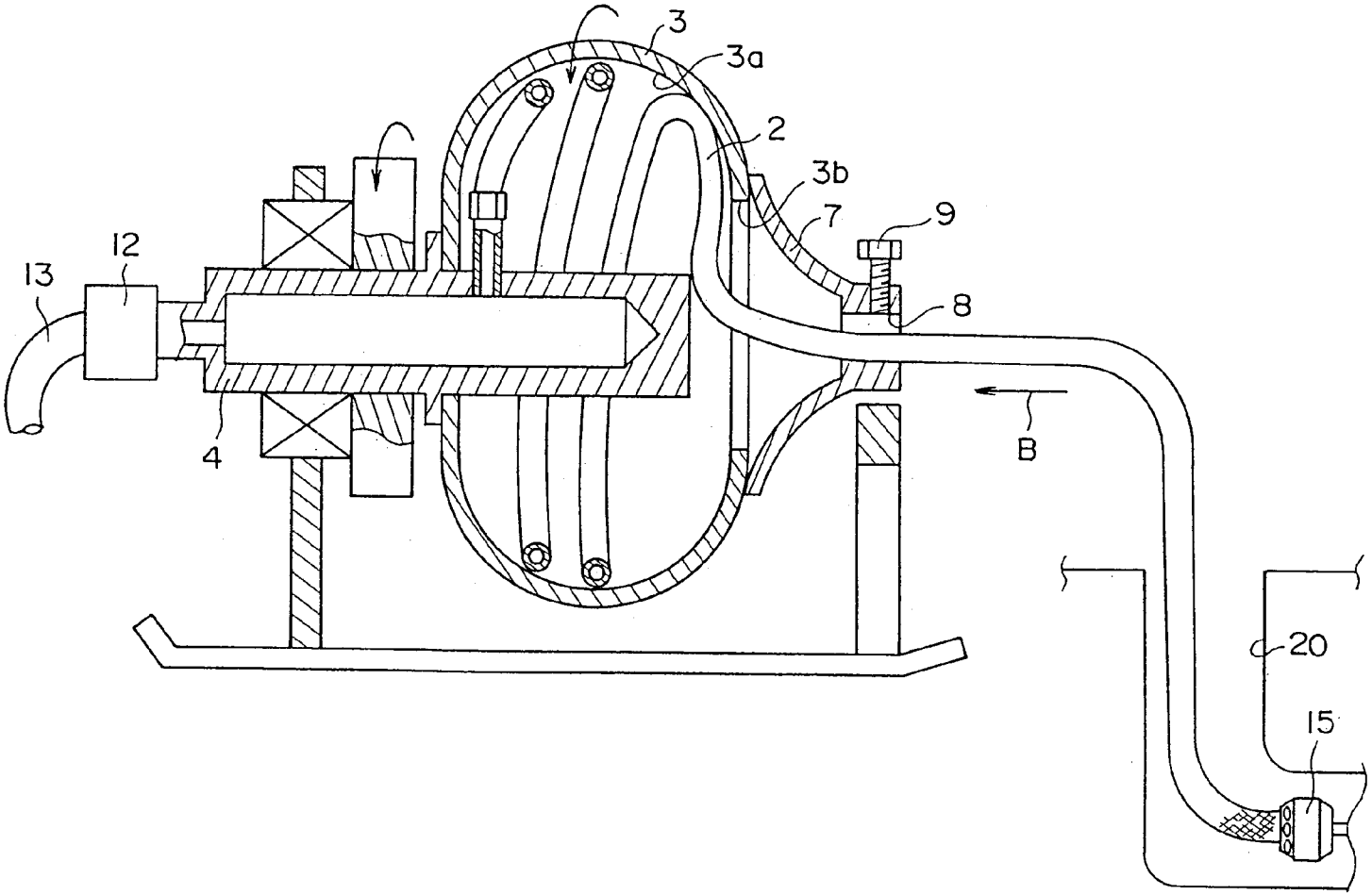
FIG.10 PRIOR ART
FIG. 10 is a schematic cross-sectional view representing the operation of the conventional washing hose storing device.

FIG. 1 is a cross-sectional view of a washing hose storing device 30 according to the present invention, wherein the same parts as in FIG. 8 are designated by the same symbols.

With this washing hose storing device 30, guide means 31 for guiding the washing hose 2 from the inner peripheral surface 3*a* of the rotary housing 3 to the extracting hole 8 are provided between the center part 4*b* at the forward end of the drive shaft forming the center of the rotary housing 3, and the extracting hole 8 formed in the center of the substantially conical cover 7. In this embodiment, moreover, a cylindrical projecting part 10 is provided as an extension concentrically with the drive shaft 4 to as much as possible prevent the high pressure hose 2 from becoming tangled.

The guide means 31 described above are configured by a single pipe shaft 32 supported so that it can freely turn between a bearing 8*a* comprising a concave portion formed in the extracting hole 8 and a bearing 4*c* comprising a concave portion formed in the center part 4*b* at the forward end of the drive shaft 4, and by a guide pipe 33 formed so that it bends toward the inner peripheral surface 3*a* of the rotary housing 3, branching from the forward end, i.e. from the extracting hole 8 end, of the pipe shaft 32. The washing hose 2 is inserted inside this guide pipe 33, extracted from the inner peripheral surface 3*a* of the rotary housing 3, and guided into the extracting hole 8.

The pipe shaft 32 described above is supported between the bearing 8*a* in the extracting hole 8 and the bearing 4*c* in the drive shaft 4 so as to provide play of a prescribed length along the direction of the axis thereof. Also, between the bearing 4*c* in the drive shaft 4 and the pipe shaft 32 supported by that bearing 4*c* are formed clutch means 35, in a dog clutch structure, such that the clutch is engaged when a concave portion and a convex portion are engaged, and such that the clutch is disengaged when the engagement between the concave portion and convex portion is released.

Next, the operation of the washing hose storing device 30 is described.

Figure 2:
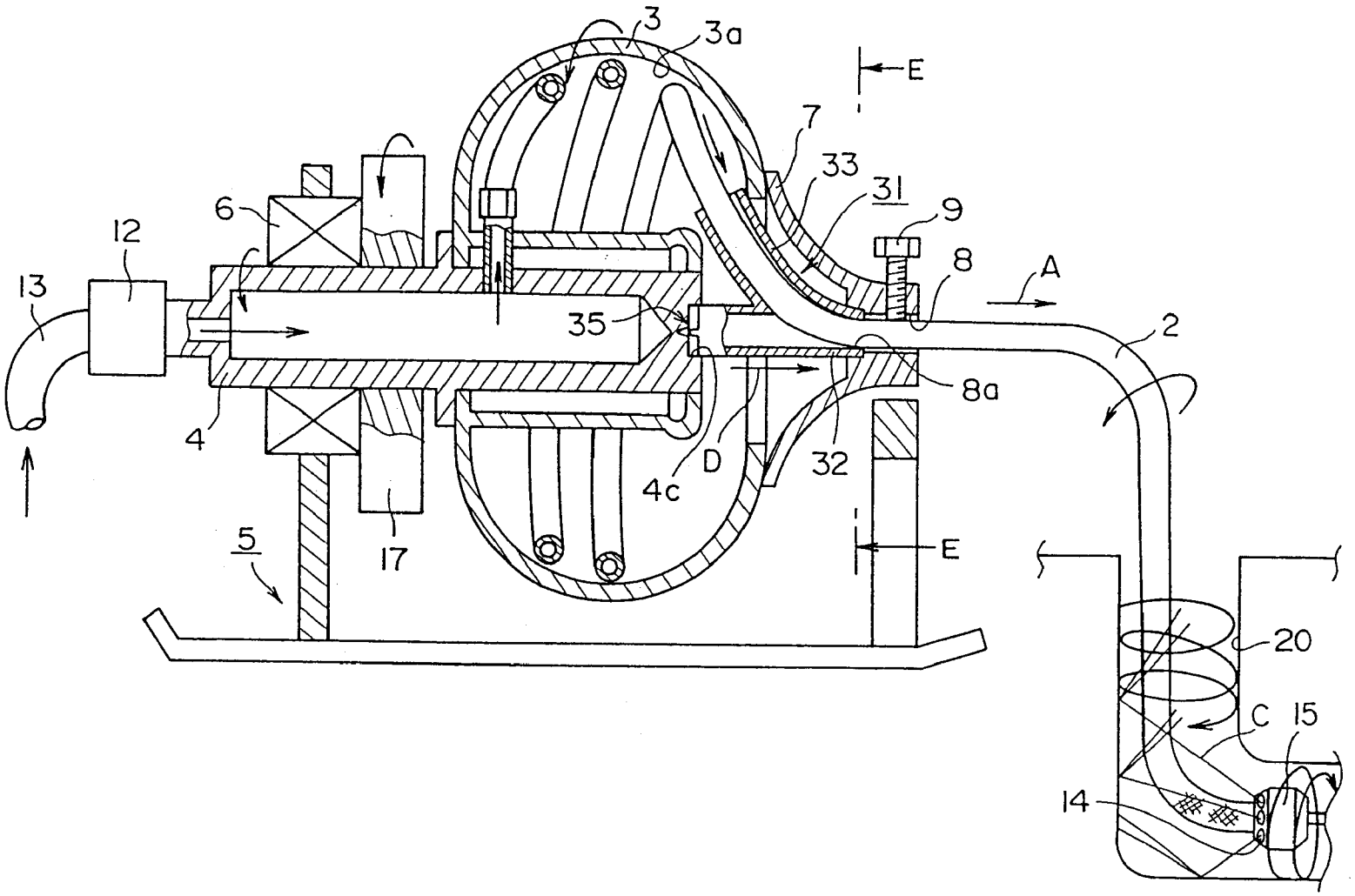
FIG. 2 is a cross-sectional view representing the operation of the washing hose storing device according to the present invention.

As diagrammed in FIG. 2, when the lock bolt 9 in the extracting hole 8 is loosened, and then the operator pulls the high pressure hose 2 out from the extracting hole 8, as indicated by the arrow A, due to a slight force of friction acting between the guide pipe 33 of the guide means 31 and the high pressure hose 2 inserted therein, the pipe shaft 32 of the guide means 31 move to the right as shown in the drawing and indicated by the arrow D, by the amount of the play. As a result, the clutch means 35 is disengaged, and the pipe shaft 32 of the guide means 31 can turn freely between the bearing 4*c* in the drive shaft 4 and the bearing 8*a* in the extracting hole 8.

At this time, that is, when the high pressure hose 2 is pulled out from the extracting hole 8, the high pressure hose 2 will be guided from the inner peripheral surface 3*a* of the rotary housing 3 to the extracting hole 8, via the guide pipe 33 of the guide means 31. Therefore, the high pressure hose 2 will not strike other parts, and hence the high pressure hose 2 will be pulled smoothly from the extracting hole 8. Thus, the operation of pulling out the high pressure hose 2 is made extremely easy.

Figure 3:
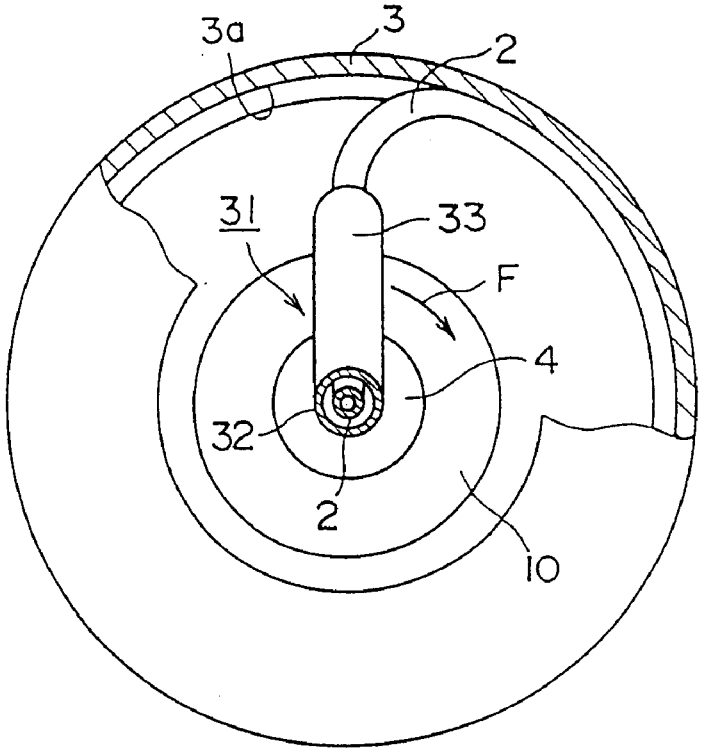
FIG. 3 is a schematic cross-sectional view at E—E in FIG. 2.
Figure 4:
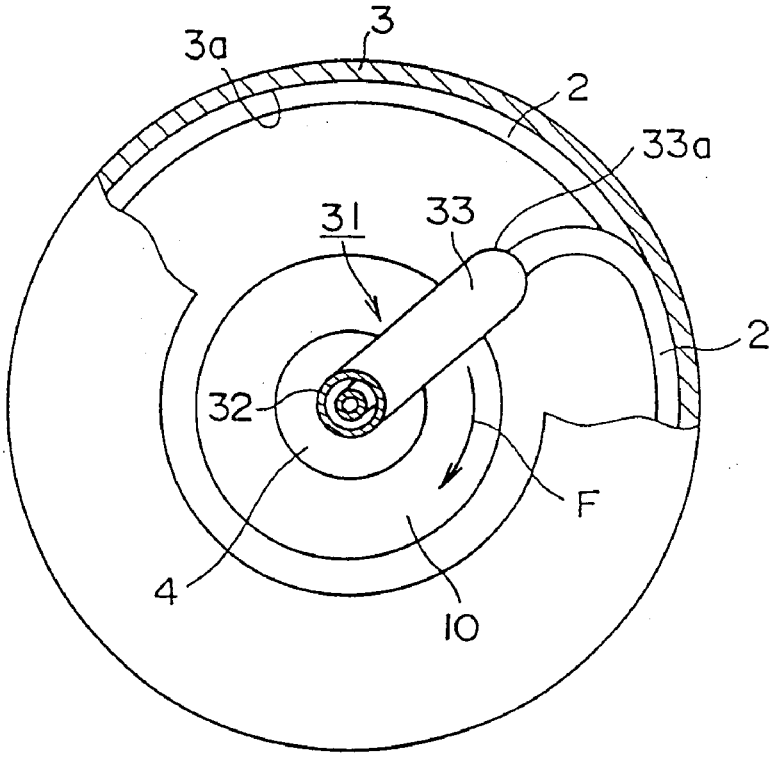
FIG. 4 is a schematic cross-sectional view at E—E in FIG. 2.

When the high pressure hose 2 is pulled out farther, as diagrammed in FIG. 3 and FIG. 4 which represent the cross section along the line E—E in FIG. 2 with the cover 7 removed, as the high pressure 2 is pulled out farther, the guide pipe 33 and pipe shaft 32 of the guide means 31 turn in the direction (arrow F) in which the high pressure hose 2 to be pulled out is wound. Therefore the wound high pressure hose 2, as diagrammed in FIG. 4, will be smoothly pulled inside the guide pipe 33 without being pulled between the inner peripheral surface 3*a* of the rotary housing 3 and the tip end 33*a* of the guide pipe 33.

During this time, furthermore, when the rotary housing 3 is turned in one direction by drive means (not shown), as diagrammed in FIG. 2, the nozzle 15 will advance while turning in a spiral pattern inside the drain pipe 20, and, during that time, the solid waste material adhering to the inside of the drain pipe 20 will be stripped away and removed by the high pressure water C jetted from the injection holes 14.

Figure 5:
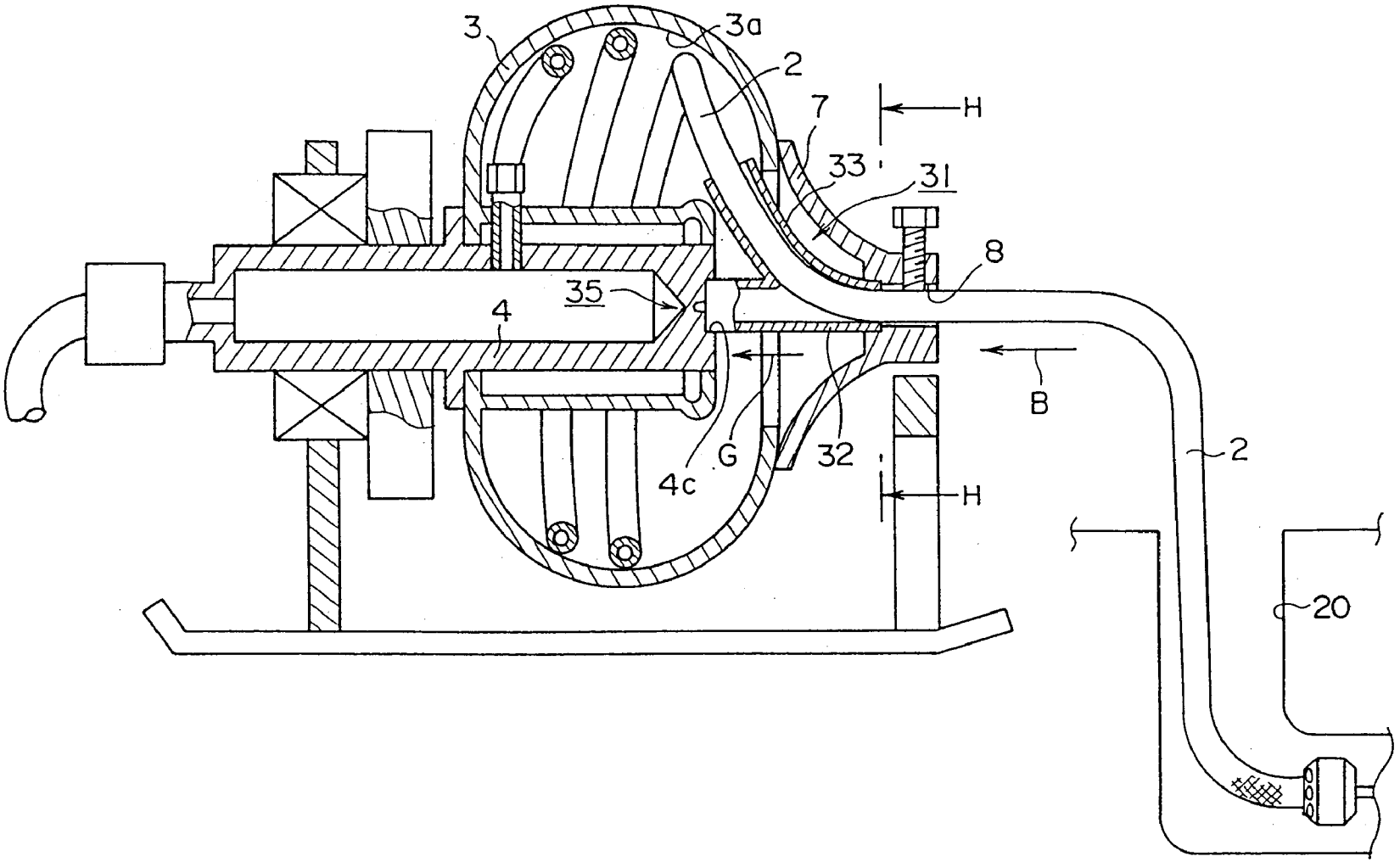
FIG. 5 is a cross-sectional view representing the operation of the washing hose storing device according to the present invention.

Then, when the washing operation in the drain pipe 20 by the high pressure water (arrow C) jetted from the nozzle 15 described earlier is finished, and the high pressure hose 2 is being taken into the rotary housing 3, the turning of the rotary housing 3 is first stopped, and then, as diagrammed in FIG. 5, the high pressure hose 2 that has been extended into the drain pipe 20 is pulled back as indicated by the arrow B, and that high pressure hose 2 is pushed into the extracting hole 8.

When that is done, due to the slight frictional force that acts between the guide pipe 33 of the guide means 31 and the high pressure hose 2 inserted therein, the pipe shaft 32 of those guide means 31 moves to the left side of the drawing, as indicated by the arrow G, by the amount of play, whereby the clutch means 35 are engaged. As a result, the pipe shaft 32 of the guide means 31 and the bearing 4*c* in the drive shaft 4 are engaged.

Figure 6:
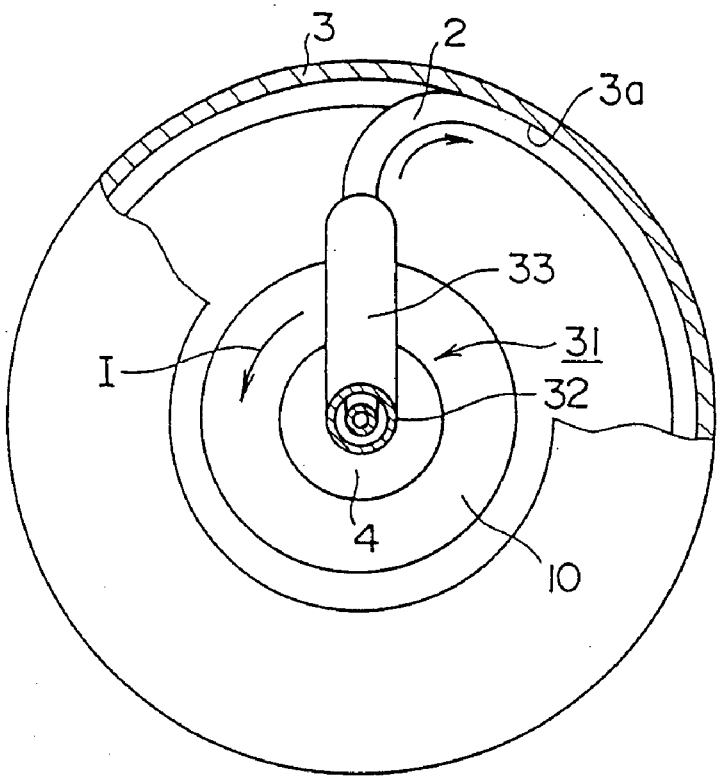
FIG. 6 is a schematic cross-sectional view at H—H in FIG. 5.
Figure 7:
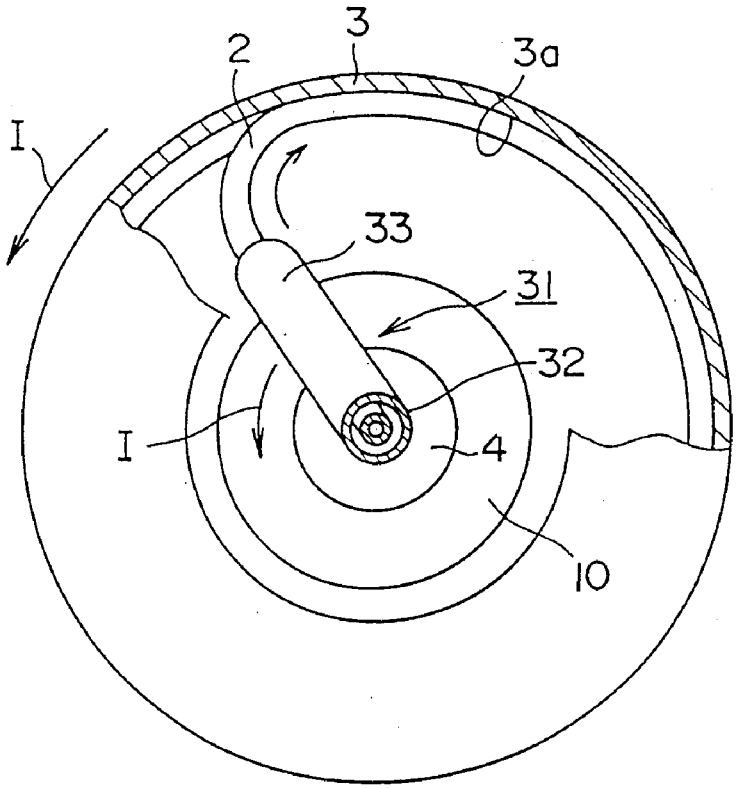
FIG. 7 is a schematic cross-sectional view at H—H in FIG. 5.

In this condition, as diagrammed in FIG. 6 and FIG. 7 which represent the cross section along the line H—H in FIG. 5 with the cover 7 removed, when the high pressure hose 2 is brought into tight contact with the inner peripheral surface 3*a* of the rotary housing 3 through the guide pipe 33 of the guide means 31, due to the springiness at that time of the high pressure hose 2 that is deformed into a curve, the guide pipe 33 and pipe shaft 32 of the guide means 31 will turn as indicated by the arrow I, and, simultaneously, the rotary housing 3 that is linked to the pipe shaft 32 will also turn in the same direction, linked to the turning of the pipe shaft 32.

At that time, that is, when the high pressure hose 2 is pulled back, the high pressure hose 2 is pushed against the inner peripheral surface 3*a* of the rotary housing 3 by the guide pipe 33 of the guide means 31. Therefore, the high pressure hose 2 does not strike other parts thereof. Therefore, not only is the high pressure hose 2 pushed against the inner peripheral surface 3*a* of the rotary housing 3 and taken in smoothly, but, simultaneously, the rotary housing 3 moves in linkage with the turning of the pipe shaft 32, turning in the same direction. Therefore, when taking in the high pressure hose 2, there is no need to turn the rotary housing 3 by drive means, thus making the operation of accommodating the high pressure hose extremely easy.

In the embodiment described in the foregoing, as diagrammed in FIG. 1, clutch means 35 are provided between the bearing 4*c* in the drive shaft 4 and the pipe shaft 32 supported by that bearing 4*c*. However, the present invention is not limited to or by that embodiment, and such clutch means 35 need not be provided. In that case, the rotary housing 3 will not turn synchronously with the pipe shaft 32, but the guide pipe 33 of the guide means 31 will turn in the direction indicated by the arrow I, and the high pressure 2 will be smoothly guided and accommodated inside the rotary housing 3.

INDUSTRIAL APPLICABILITY

As described in the foregoing, the washing hose storing device according to the present invention is well suited to the operation of driving a washing hose used in a drain pipe washing device, and to the accommodation of such washing hose.

What is claimed is:

1. A washing hose storing device in which a washing hose is wound up so as to be in tight contact with an inner peripheral surface of a substantially cylindrical rotary housing, and when the washing hose is to be used, the washing hose is pulled out from an extracting hole formed at a position in opposition to a center part of the rotary housing and when not in use, the washing hose is pulled back inside the extracting hole, wound up so as to be in tight contact with the inner peripheral surface of the rotary housing, and accommodated, wherein:

guide means for guiding the washing hose from inner peripheral surface of the rotary housing to the extracting hole is provided between the extracting hole and the center part of the rotary housing, said guide means comprising a pipe shaft that is supported rotatably between the center part of the rotary housing and the extracting hole, and a guide pipe that branches away from the pipe shaft and is formed to be curved toward the inner peripheral surface of the rotary housing.

2. The washing hose storing device according to claim 1, wherein the washing hose comprises a stainless steel hose that is comparatively rigid and does not readily bend.

3. The washing hose storing device according to claim 1, wherein a clutch means is provided between the center part of the rotary housing and the pipe shaft, the clutch means being disengaged when the washing hose is being pulled out, and being engaged when the washing hose is being pulled back.

* * * * *